United States Patent [19]

Dore

[11] Patent Number: 4,823,911

[45] Date of Patent: Apr. 25, 1989

[54] LADDER SCAFFOLD

[76] Inventor: Steven A. Dore, 5316 191st St. SW., Lynnwood, Wash. 98036

[21] Appl. No.: 232,351

[22] Filed: Aug. 15, 1988

[51] Int. Cl.[4] ..... E06C 7/16; E04G 1/30

[52] U.S. Cl. ..... 182/119; 182/122; 248/238

[58] Field of Search ..... 182/118, 119, 121, 122; 248/238, 210

[56] References Cited

U.S. PATENT DOCUMENTS

| | | | |
|---|---|---|---|
| 711,384 | 10/1902 | Carman | 182/119 |
| 1,351,795 | 9/1920 | Schnabel | 182/119 |
| 1,664,073 | 3/1928 | Haywood | 182/119 |
| 2,318,493 | 5/1943 | Johnson | 182/119 |
| 2,544,368 | 3/1951 | Thorne | 248/238 |
| 2,619,390 | 11/1952 | Johnson | 182/119 |
| 2,637,517 | 5/1953 | Brensike | 182/119 |
| 2,656,223 | 10/1953 | Gray | 182/119 |
| 2,778,595 | 1/1957 | Mastin | 248/238 |
| 4,542,874 | 9/1985 | Roning | 248/238 |

*Primary Examiner*—Reinaldo P. Machado
*Attorney, Agent, or Firm*—Robert W. Beach; Ward Brown

[57] ABSTRACT

A scaffold plank hanger is suspended from a rung of a ladder by hooks engaging such rung which are spaced apart less than the width of the ladder. Such hooks carry a crossbar of a length greater than the width of the ladder. A scaffold plank has hooks projecting from one end which are hooked over opposite end portions of the hanger crossbar between its ends and the adjacent ladder rails, respectively.

1 Claim, 1 Drawing Sheet

LADDER SCAFFOLD

BACKGROUND OF THE INVENTION

1. Field of the Invention

This invention relates to a ladder scaffold composed of a scaffold plank, a ladder and a hanger supporting one end of the scaffold plank from such ladder.

2. Prior Art

U.S. Pat. No. 1,351,795, issued Sept. 7, 1920, discloses an attachment for ladders for hanging a scaffold plank from and between ladders spaced apart a distance approximately equal to the length of the scaffold plank. The attachment is intended to support each end of the scaffold plank from two rungs of a ladder but it would be very difficult to adjust the device so that the load of the scaffold plank would be shared equally by each of two rungs. At best great care would be required to provide the intended adjustment and alteration of loading on the scaffold plank could alter the load distribution between the rungs.

U.S. Pat. No. 2,637,517, issued May 5, 1953, discloses a ladder bracket having some features similar to those of the ladder bracket of the present invention but such bracket is considerably more complicated and would be more difficult to use.

U.S. Pat. No. 2,619,390, issued Nov. 25, 1952, shows a scaffolding plank having hooks at the ends somewhat similar to the scaffold plank used in the present invention but this patent requires special ladders to support the scaffold plank.

U.S. Pat. No. 4,542,874, issued Sept. 24, 1985, discloses a stop lug on the end of a plank supporting arm which is generally similar to the stop lug used in the present invention.

SUMMARY OF THE INVENTION

The present invention relates to a ladder scaffold including a hanger for supporting a scaffold plank end from a ladder which can be used to support planks of somewhat different widths from ladders of different widths.

It is an object to provide a plank hanger that can be suspended from ladders of different widths quickly, conveniently and reliably and which can support the ends of scaffold planks of somewhat different widths easily and reliably.

The foregoing objects can be accomplished by use in combination with a ladder and a hanger including a scaffold plank supporting crossbar carried by two spaced hooks that are engageable over a rung of the ladder. The length of the crossbar is greater than the width of the ladder so that the end portions of the crossbar projecting laterally beyond the ladder rails can bear against such ladder rails. The end of the scaffold plank has hooks engageable with the end portions of the crossbar projecting laterally beyond the ladder rails. Lugs secured to opposite ends of the crossbar provide stops for preventing the scaffold plank hooks from sliding endwise off the crossbar.

DETAILED DESCRIPTION

The ladder 1 is conventional, being composed of parallel rails R connected by rungs R'. For stability the rails R may diverge or flare downwardly somewhat. The lower portions of the rails may actually be curved away from each other to increase the width of the ladder at the base. Preferably the ladder is of the free standing type which may be effected by the ladder being double-sided or of an A-frame type, being composed of two upwardly converging ladders back to back connected at the top.

The purpose of the present invention is to support a scaffold plank S between spaced ladders and usually parallel to a wall on which work can be done by workers standing on the scaffold plank. A type of scaffold plank desirable for the present invention includes a platform P with parallel flanges F extending downward from opposite edge portions of the platform.

Figure 1:
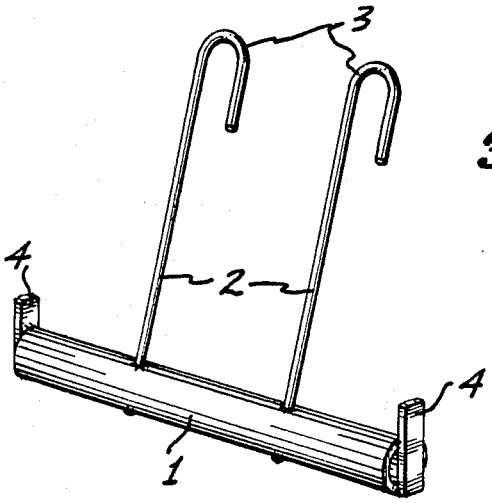
FIG. 1 is a top perspective of the scaffold plank hanger component.

The scaffold plank S is supported from the ladder L by a hanger shown best in FIG. 1 that includes a crossbar 1 which preferably is tubular and is supported by hooks spaced lengthwise of the crossbar. Such hooks include shanks 2 extending through the crossbar and having hooked ends 3 remote from the crossbar. The shanks 2 can be secured to the crossbar by having their ends welded or threaded and provided with retaining nuts. The opposite ends of the crossbar 1 have lugs 4 projecting upwardly beyond the crossbar to serve as stops.

Figure 2:
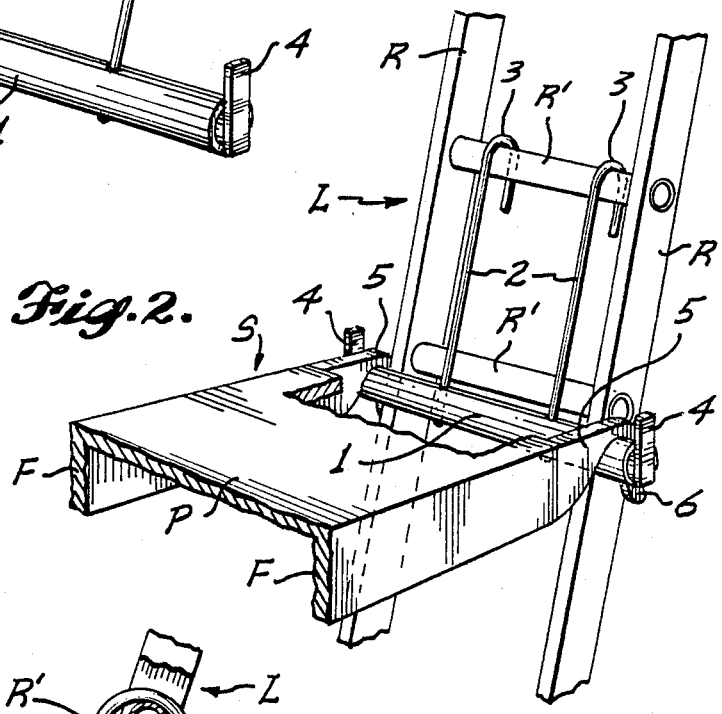
FIG. 2 is a top perspective of the combination of a supporting ladder and the hanger supporting one end of a scaffold plank from the ladder.
Figure 3:
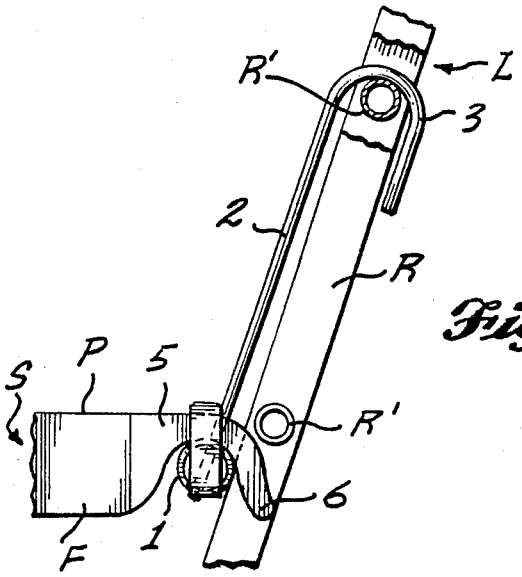
FIG. 3 is a side elevation of the ladder, scaffold plank end and hanger in assembled relationship, parts being broken away.

The spacing between the crossbar supporting hooks should be substantially as great as possible and still be sufficiently small so that the hooks will be spaced more closely than the distance between opposite rails R of ladders with which the plank hangers are to be used. The length of the crossbar 1 should be greater than the width of the largest ladder with which the hanger is to be used so that the opposite end portions of the crossbar will engage the edges of the opposite rails R of the ladder when the hanger is mounted on the hanger, as shown in FIGS. 2 and 3.

Preferably the spacing between one of the hook shanks 2 and the end of the crossbar 1 more remote from such hook shank will be at least as great as the width of the ladder to which the hanger is to be attached so that when the shank is in engagement with the inside surface of one ladder rail R the remote end of the crossbar will be engaged with the edge of the other ladder rail.

By spacing the hook shanks 2 as far apart as possible while still being able to accommodate them between the rails R of the ladder, the load of the plank supported by the hooks 3 will be transmitted to a rung at its end portions adjacent to the railings R so that the load will be imposed on the rung primarily in sheer with very little load being imposed in bending. Also, it is preferred that the lengths of the hanger shanks 2 be generally equal to the spacing between the rungs R' of the ladder, as shown in FIGS. 2 and 3.

From each end of the scaffold plank project hooks 5 spaced transversely of the plank and having somewhat elongated downwardly projecting tips 6. It is preferred that the hooks 5 be spaced apart a distance greater than the width of the ladder but less than the length of the crossbar 1 of the hanger. When the hooks 5 are hooked over the opposite end portions of the crossbar 1, therefore, as shown in FIGS. 2 and 3, the hooks will be located between the ladder rails and the opposite ends of the crossbar respectively. In this position one or the other of the hooks 5 will engage one or the other of the stop lugs 4 to prevent the hooks from sliding off the end of the crossbar. Also, the hook tips 6 would project downward alongside the rails R so that engagement of such hook tips with a rail would limit transverse shifting of the scaffold plank relative to the crossbar.

To assemble the scaffold and ladder it is merely necessary to hook the hooks 3 of the hanger over a rung of the ladder and to hook the hooks 5 on one end of a scaffold plank over the opposite end portions of the crossbar 1. If the plank should be moved lengthwise away from the ladder L to some extent, the crossbar 1 would swing out of contact with the edges of the ladder rails but there would be no appreciable change in the loading of the ladder rung by the weight of the scaffold plank.

I claim:

1. The combination of a ladder having generally parallel rails connected by rungs, a scaffold plank having hooks projecting from one end thereof and disposed respectively alongside the outer sides of said ladder, and a scaffold plank hanger bearing against the edges of said ladder rails having a crossbar the end portions of which crossbar project beyond the opposite sides of said ladder, and are engaged by said scaffold plank hooks, and said hanger having elongated hooks spaced apart a distance somewhat less than the width of said ladder and having hooked upper end portions engaged over a rung of said ladder.

* * * * *